US009551105B2

(12) United States Patent
Bae et al.

(10) Patent No.: US 9,551,105 B2
(45) Date of Patent: Jan. 24, 2017

(54) CONTROLLING METHOD OF A DRYER AND A DRYER WITH THE SAME

(75) Inventors: Sang Hun Bae, Changwon-si (KR); Chang Woo Son, Changwon-si (KR); Ju Han Yoon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1991 days.

(21) Appl. No.: 12/155,843

(22) Filed: Jun. 10, 2008

(65) Prior Publication Data

US 2008/0313922 A1 Dec. 25, 2008

(30) Foreign Application Priority Data

Jun. 15, 2007 (KR) ..... 10-2007-0058865

(51) Int. Cl.
*D06F 58/28* (2006.01)
*D06F 58/20* (2006.01)

(52) U.S. Cl.
CPC ..... *D06F 58/28* (2013.01); *D06F 58/203* (2013.01); *D06F 2058/2851* (2013.01)

(58) Field of Classification Search
CPC . D06F 58/28; D06F 58/203; D06F 2058/2851
USPC ..... 34/380, 389, 390, 418, 425, 427, 491,34/524, 60, 90; 68/5 R, 5 C
See application file for complete search history.

(56) References Cited

U.S. PATENT DOCUMENTS

| | | | | |
|---|---|---|---|---|
| 4,019,259 | A * | 4/1977 | Veraart | 34/550 |
| 4,733,479 | A * | 3/1988 | Kaji et al. | 34/446 |
| 4,763,425 | A * | 8/1988 | Grennan | 34/552 |
| 2006/0005581 | A1* | 1/2006 | Banba | 68/5 R |
| 2006/0048405 | A1* | 3/2006 | Baek et al. | 34/443 |
| 2006/0277690 | A1* | 12/2006 | Pyo et al. | 8/149.2 |

FOREIGN PATENT DOCUMENTS

| | | | |
|---|---|---|---|
| DE | 101 34 971 | A1 | 2/2003 |
| JP | 3-284300 | | 12/1991 |
| JP | 5-245297 | | 9/1993 |
| KR | 20040015957 | A * | 2/2004 |
| KR | 10-2004-0100555 | | 12/2004 |
| KR | 10-2006-0033065 | | 4/2006 |
| KR | 10-2006-0095710 | | 9/2006 |
| KR | 10-2007-0023886 | | 3/2007 |
| WO | WO 2006/101345 | A1 | 9/2006 |

* cited by examiner

*Primary Examiner* — Jiping Lu
(74) *Attorney, Agent, or Firm* — Dentons US LLP

(57) ABSTRACT

A controlling method of a clothes dryer for detecting an amount of laundry and a clothes dryer with the same are disclosed. A controlling method includes drying laundry by supplying hot air to a drum, determining an amount of laundry based on a drying time, and supplying fine droplets of water and/or steam to the drum according to the determined amount of laundry.

15 Claims, 6 Drawing Sheets

CONTROLLING METHOD OF A DRYER AND A DRYER WITH THE SAME

This application claims the benefit of Korean Patent Application No. 10-2007-0058865, filed on Jun. 15, 2007, which is hereby incorporated by reference in its entirety.

BACKGROUND

Field of the Disclosure

The disclosure relates to a home appliance. More particularly, to a controlling method of a home appliance, such as clothes dryer to detect an amount of laundry put therein and supply fine droplets of water and/or steam according to the detected laundry amount.

Discussion of the Related Art

Clothes dryers are home appliances for drying washed laundry by using hot air. Typically, a clothes dryer includes a drum for holding laundry, a driving source for driving the drum, a heating means for heating air drawn into the drum and a blower unit for sucking or discharging the air inside or from the drum.

Clothes dryers may be categorized based on a method of heating air. For example, a dryer may be categorized by its heating means into electric type dryers and gas type dryers. In the electric dryer, air is heated by using ohmic heating. In the gas type dryer, air is heated by heat generated by gas exhaustion. Dryers may be categorized into condensation type (circulation type) dryers and exhaustion type dryers. In the condensation type dryer, air is heat exchanged with laundry in the drum and the heat exchanged humid air is circulated, not discharged outside. The air is heat exchanged in a condenser and the condensed water is discharged outside. In the exhaustion type dryer, air is heat exchanged with laundry in the drum and the heat exchanged humid air is exhausted outside directly. Furthermore, dryers may be categorized based on a method of loading laundry into top loading type dryers and front loading type dryers. In the top loading type dryer, laundry is loaded through a top of the dryer. In the front loading type dryer, laundry is loaded through a front of the dryer.

Recently, steam dryers for drying laundry and using steam are being released. Steam is used to release or remove wrinkles from the laundry.

SUMMARY

Accordingly, a controlling method of a clothes dryer for detecting an amount of laundry put therein and providing fine droplets of water, such as steam, according to the determined amount of laundry is highly desirable.

Advantages, objects, and features of the disclosure will be set forth in part in the description which follows and in part will become apparent to those having ordinary skill in the art upon examination of the following or may be learned from practice of the invention.

An embodiment of a controlling method of a clothes dryer includes drying laundry by supplying hot air to a drum, determining an amount of laundry based on a drying time, and supplying fine droplets of water and/or steam to the drum according to the determined amount of laundry.

Generally, a larger laundry amount corresponds to a longer is drying time. As a result, if a relation between the drying time and the laundry amount is determined, then the laundry amount can be determined based on the measured drying time. A heater can be operated continuously when measuring the drying time.

The relation between the drying time and the laundry amount may be achieved through a table gained by experiments or various iterations. The relation and/or a table may be stored in a memory inside the clothes dryer. Then, after the drying time is measured, then the corresponding laundry amount is read from the table to determine the laundry amount. Alternatively, the relation between the drying time and the laundry amount may be defined by a formula and calculated therefrom.

The drying time may refer to an amount of time taken to perform the a complete drying process. The drying time may refer to an amount of time taken for drying the laundry up until a predetermined degree of dryness. These are just a few examples of a drying time that may used, applied, or designated. In addition, a sensor may be used to sense the dryness of the laundry to determine whether the predetermined degree of dryness is achieved.

The drying time may be determined as a time taken for a temperature for indicating a degree of dryness of the laundry to rise from a first temperature to a second temperature.

The temperature indicates a degree of dryness. For example, the temperature may refer to an atmosphere temperature inside the drum or a temperature of air exhausted from the drum.

As hot air is supplied to the drum, the moisture within the drum is evaporated and discharged outside. Then, the temperature inside the drum may rise during this time. As a result, it can be said that the time taken for the temperature inside the drum to rise relates to the drying time.

Generally, a greater laundry amount corresponds to a longer time period for the temperature inside the drum to reach a predetermined temperature. As a result, the laundry amount may be determined by using the relation between the time taken for the drum temperature to rise up until a predetermined temperature and the laundry amount.

For example, a data table or a formula may be generated by measuring the time taken for the drum temperature to rise a predetermined temperature. And the laundry amount put in the clothes dryer may be determined by using the table or the formula.

A sensor may be provided to directly sense the temperature inside the drum.

In the meantime, a limit temperature for the drum temperature while drying the laundry may be predetermined to prevent the laundry from being damaged by the heat. If the drum temperature reaches the limit temperature, the supplying of the hot air is interrupted temporarily or permanently. The limit temperature may be used as an upper limit of the predetermined temperature range. That is, the laundry amount may be determined by the relation between the laundry amount and the time taken for the drum temperature to reach the limit temperature.

Specifically, the laundry amount is determined by the relation between the laundry amount and an amount of time for the drum temperature to reach the limit temperature from the moment when the hot air is supplied to the drum to perform the drying. This time period can be measured from when the drum temperature reaches the limit temperature, instead of measuring the time when the process of supplying hot air starts. That is, a lower limit of the temperature range is predetermined. The time taken from the lower limit to the upper limit may be used.

The drying time is determined as an operation time of a heater to heat the air. The operation time of the heater also relates to the drying time. A larger laundry amount generally corresponds to a longer period of time in which the heater is operated. This information may be used to determine the laundry amount under the given circumstances.

The laundry amount determined by the method described above may be applied when fine droplets of water, such as steam, are supplied to the laundry. For example, the laundry amount may be used to determine a moisture supply time period and the fine droplets of water may be supplied during the moisture supply time period. Depending on an object of using moisture, the system may supply relatively low temperature fine droplets of water instead of steam, which can be defined as high temperature fine droplets of water.

For the supplying steam, a steam generator can be provided in the clothes dryer. The steam generator is a device for generating steam by heating water. A controller of the clothes dryer can control a pump or a valve to supply water to the steam generator. The steam generator may control a heater for heating water to generate steam. Since the steam generator is directly controlled by the controller of the dryer, it is possible to adjust the time or time period associated with supplying steam and/or the amount of steam.

A device may be provided to make fine particles of water by using vibration of ultra sonic waves. Alternatively, a spray or a nozzle, which turns pressurized water into fine droplets, may be used. Also, other devices for making fine droplets of water and/or steam by other methods may be used.

Determining the laundry amount may include determining an amount of laundry based on a drying time period at a predetermined time after a heater starts to supply hot air to the drum. When the drying process is continued after drying to a predetermined degree of dryness or when the drying is complete, the laundry amount may be determined. The fine droplets of water and/or steam may be supplied based on the determined amount of laundry. When the laundry is wet, it may be difficult to measure the laundry amount with precision because of the amount of moisture, which may be contained in the laundry. The temperature determination range, defined as a first temperature and a second temperature, may correspond to a temperature range showing that the relation between the drying time and the dryness indicating temperature is linear. This linear model may be applicable to other embodiments.

This disclosure presents a method for determining the amount of laundry. It is efficient to supply fine droplets of water and/or steam based on the laundry amount that is determined according to the time taken for the laundry to be dried.

For example, if fine droplets of water and/or steam are supplied based on an amount of laundry, which is determined only based on the number or weight of cloth items, then the system may supply too much steam to the laundry.

Here, a determination of the laundry amount, as described above, can be used to control the supplying time of hot air or cool air, the rotation of the drum, and variations thereof.

It is to be understood that both the foregoing general description and the following detailed description are exemplary and explanatory and should not be construed as limiting the scope of any claim.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE ILLUSTRATED EMBODIMENTS

Reference will now be made in detail to the illustrated embodiments disclosed herein, examples of which are illustrated in the accompanying drawings. Wherever possible, the same reference numbers will be used throughout the drawings to refer to the same or like parts.

Figure 1:
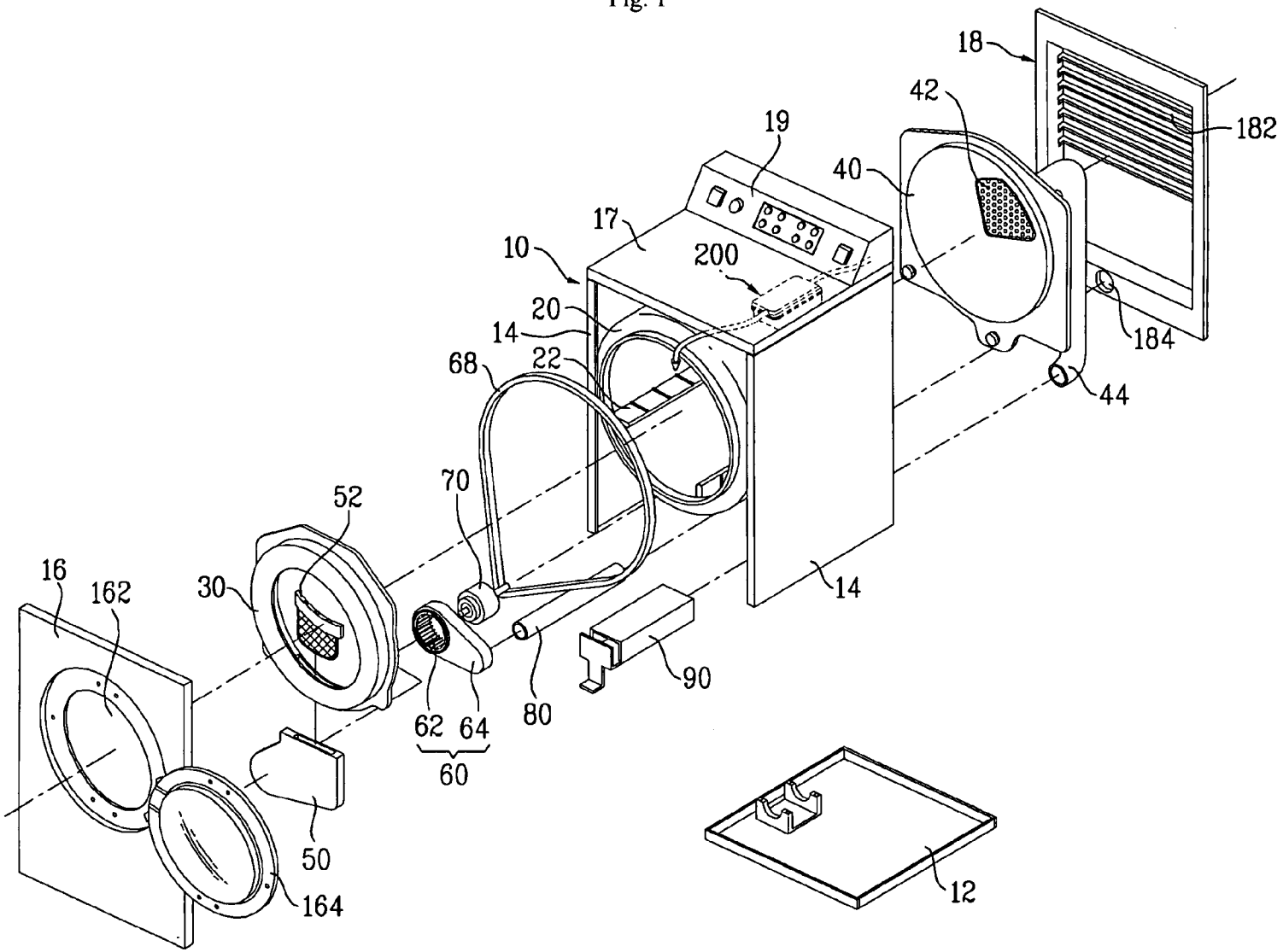
FIG. 1 is an exploded perspective view illustrating a clothes dryer.
Figure 2:
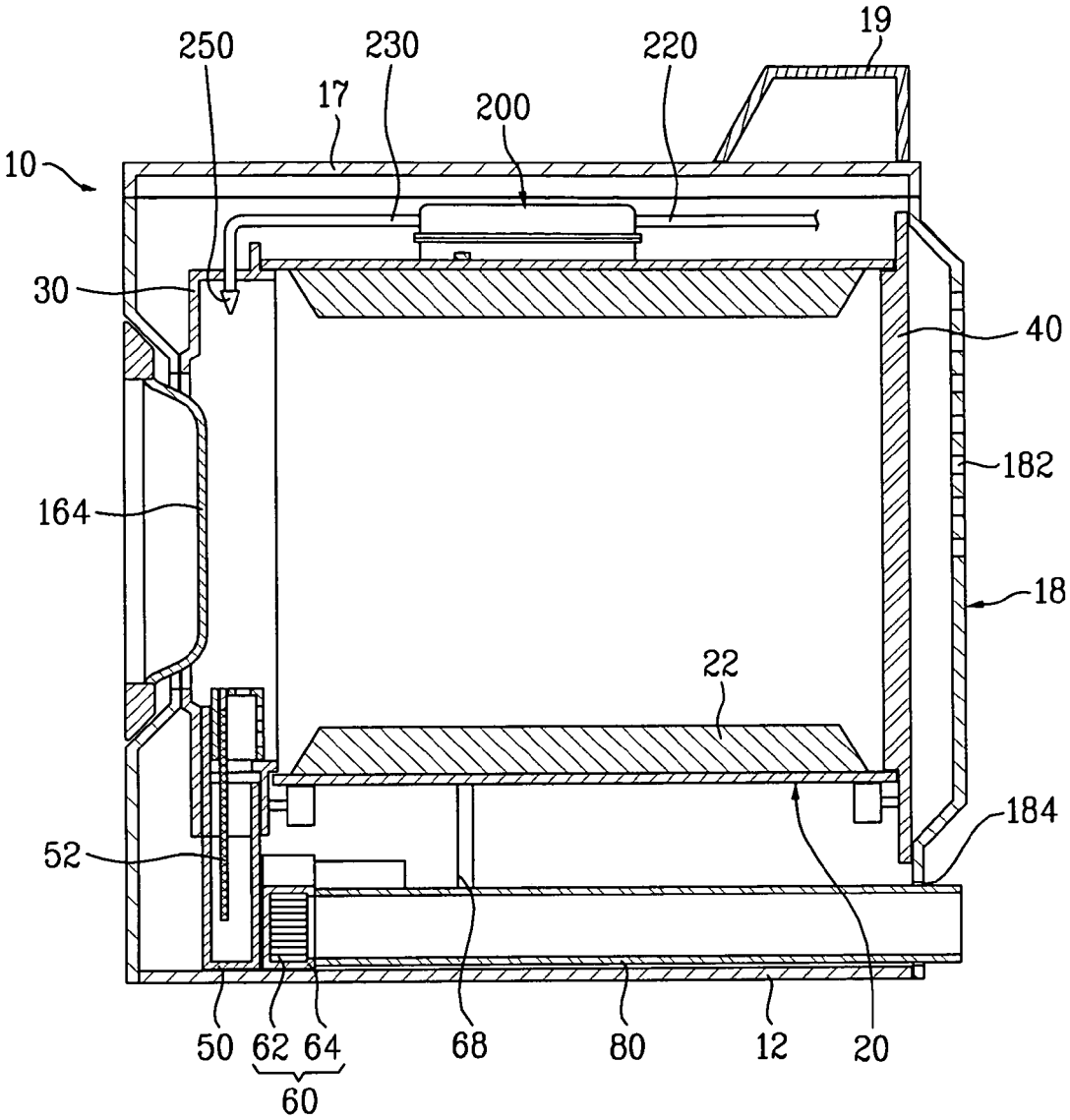
FIG. 2 is a sectional view of the clothes dryer.

FIGS. 1 and 2 illustrate a clothes dryer including a steam generator.

A rotatable drum 20, a motor 70 and a belt 68 are provided in a cabinet that defines an exterior structure of the clothes dryer. The motor 70 and the belt 68 are configured to drive the drum 20. A heater 90 and a hot air supply duct 44 are provided in a predetermined portion of the cabinet 10. The heater 90 (hereinafter, "a hot air heater") heats air to generate hot air and the hot air generated by the heater 90 is supplied to the drum 20 through the hot air supply duct 44. An exhaustion duct 80 and a blower unit 60 are provided in the cabinet 10. The humid air heat exchanged with the laundry in the drum 20 is exhausted through the exhaustion duct 80 and the blower unit 60 draws in the humid air. In addition, a thermostat (not shown) may be provided in the cabinet 10 to measure a temperature of gas that is exhausted from the drum 20.

A steam generator 200 may be provided in the cabinet 10 to generate high temperature steam. FIG. 1 illustrates a drum 20 rotated by the motor 70 and the belt 68. FIG. 1 is an indirect drive type system and this disclosure is not limited thereto. For example, a direct drive type system in which a motor is directly mounted to a rear surface of the drum 20 to directly drive the drum 20 may be also applicable to the present invention.

Each of the components will be explained.

The cabinet 10 defines an exterior appearance of the clothes dryer and includes a base 12, a pair of side covers 14, a front cover 16 and a rear cover 18. The base 12 defines a bottom of the dryer and the side covers 14 are installed perpendicular to the base 12 at respective sides thereof. The front cover 16 is installed at a front of the side cover 14 and the rear cover 18 is installed at a rear of the side cover 14. A control panel 19 may be placed at the top cover 17 or the front cover 16. Various kinds of operational switches are provided at the control panel 19. The front panel 16 includes an opening 162. A door 164, corresponding to opening 162, is coupled to the front cover 16. An inlet 182 and an outlet 184 are provided at the rear cover 16. External air is drawn through the inlet 182. The air inside the drum 20 is discharged through the outlet 184 to a space outside of the dryer.

An inner space of the drum 20 may be functioned as a drying chamber for drying laundry. Lift(s) 22 may be installed in the drum 20 to lift and drop the laundry to enhance drying efficiency.

A front supporter 30 is provided between the drum 20 and the cabinet 10, specifically, between the drum 20 and the front cover 16. A rear supporter 40 is provided between the drum 20 and the rear cover 18. Here, a sealing member (not shown) may be provided between the front supporter 30 and the drum 20 and between the rear supporter 40 and the drum 20 to prevent water leakage. That is, the front supporter 30 and the rear supporter 40 close a front surface and a rear surface of the drum 20 to form a drying chamber, as well as to support a front end and a rear end of the drum 20.

An opening is formed at the front supporter 30, enabling the drum to communicate with a space outside of the dryer. The opening is selectively opened and closed by the door 164. In addition, a lint duct 50 is connected with the front supporter 30. The air inside the drum 20 is discharged outside through the lint duct 50. A lint filter 52 is installed within the lint duct 50. An end of the blower unit 60 is connected with the lint duct 50 and the other end is connected with the exhaustion duct 80. The exhaustion duct 80 is in communication with the outlet 184 provided at the rear cover 18. As a result, if the blower unit 60 operates, the air inside the drum 20 is discharged outside through the lint duct 50, the exhaustion duct 80 and the outlet 184. At this time, foreign substances including lint are filtered through the lint filter 52. The blower unit 60 includes a blower 62 and a blower housing 64. The blower 62 is connected with the motor 70 for driving the drum 20. When operating the motor 70, the blower unit 60 and the drum 20 are driven together. The blower 62 and the drum 20 may be configured to drive separately. In this case, two motors may be connected with the blower 62 and the drum 20, respectively.

An open portion 42 is formed at the rear supporter 40. The open portion 42 is configured to include a plurality of through holes. Here, the hot air supply duct 44 is connected with the open portion 42 and the hot air supply duct 44 is in communication with the drum 20 as a path to supply the hot air to the drum 20. The hot air heater 90 is installed at a predetermined portion of the hot air supply duct 44.

The drying machine includes a controller 600 and associated memory 602. Memory 602 stores instructions, which, when executed by the controller 600, controls components of the dryer and the steam generator 200 according to a controlling method as shown, for example, in FIGS. 5 and 6.

Figure 3:
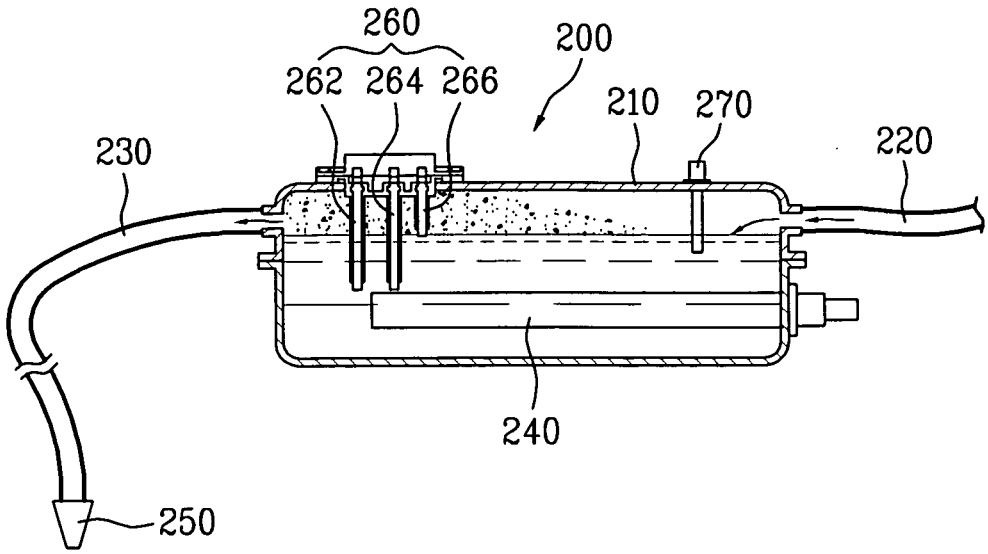
FIG. 3 is a diagram illustrating a steam generator provided in the dryer of FIG. 2.

In the meantime, a steam generator 200 is installed within the cabinet 10 to generate and supply steam to the drum 20. In reference to FIG. 3, the steam generator 200 will be explained in detail.

The steam generator 200 includes a container 210, a heater 240, a water level sensor 260 and a temperature sensor 270. Water is held in the container 210 and the heater 240 is mounted in the container 210. The water level sensor 260 senses a water level of the steam generator 200 and the temperature sensor 270 senses a temperature of the steam generator 300. The water level sensor 260 typically includes a common electrode 262, a low water level electrode 264 and a high water level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply hose 220 is connected to a predetermined portion of the steam generator 200 and a steam hose 230 is connected opposite to predetermined portion of the steam generator 200. A nozzle 250 having a predetermined shape may be provided at a front end of the steam hose 230. An end of the water supply hose 220 may be connected to an external water supply source such as a water tap. The nozzle 250, which serves as a steam outlet, is positioned at a predetermined portion in the drum 20 to spray steam in the drum 20.

In the meantime, this embodiment includes a kind of steam generator 200 in which the heater 240 heats the water in the tank 210 to generate steam (called a "tank heating type steam generator") and this disclosure is not limited thereto. That is, any device capable of generating steam may be applicable to this disclosure. For example, a kind of a steam generator in which a heater is directly installed around a water supply hose to heat the water in the water supply hose, without storing water in a predetermined space, (called "a pipe heating type steam generator") may be applicable to this disclosure.

Figure 4:
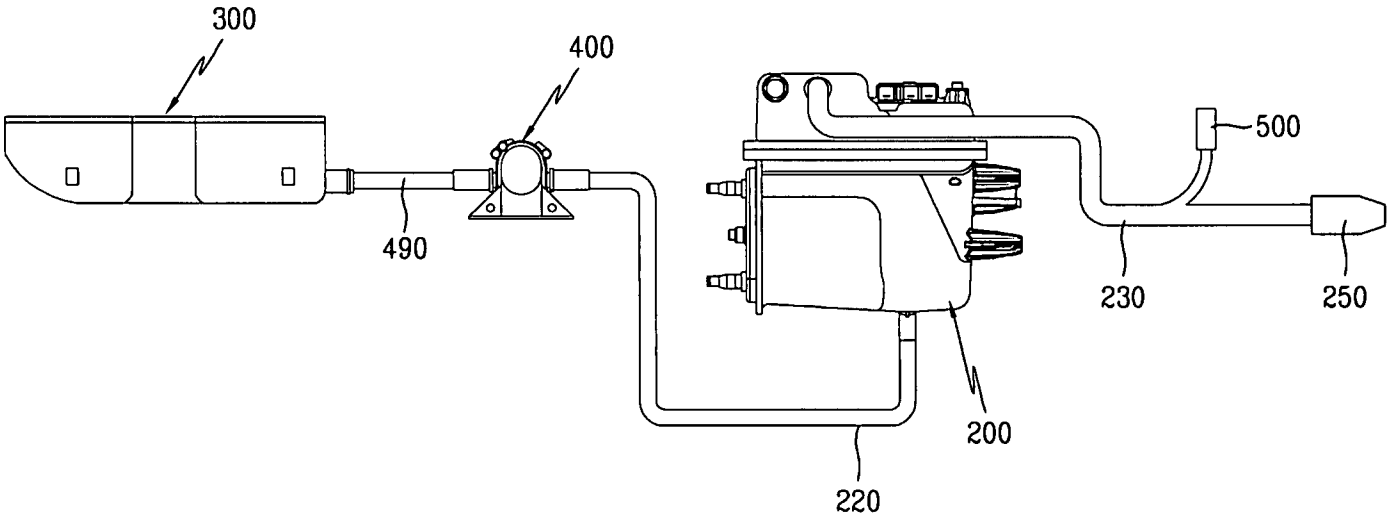
FIG. 4 is a diagram illustrating another embodiment of a steam generator.

FIG. 4 is a diagram schematically illustrating another embodiment of a steam generator.

This embodiment illustrates a steam generator that includes a detachable/attachable water supply source. The water supply source might be a water tap like in the above embodiment and its installation structure may be complex because additional installation of various devices may be necessary. Alternatively, water may supplied by a water tank 300. The water tank 300 is filled with water and is connected to the steam generator 200 via a water supply path 490, a pump 400, and a water supply hose 220. An attachable/detachable water tank 300 may be a convenient water supply source. The water tank 300 is not limited to the detachable one described above. As another example, the dryer may include a water tank that is fixed to the dryer. Another kind of a water source may be used instead of the water tank.

In addition, a pump 400 may be provided between the water tank 300 and the steam generator 200. It is preferable that the pump 400 is rotatable in a clockwise and counter-clockwise direction such that the pump 400 allows water to be supplied to or drained from the steam generator 200.

It is possible to supply water to the steam generator 200 by using water level difference between the water supply source 300 and the steam generator 200, without the pump 400. However, the structural space may be insufficient because various parts of dryers are standardized and compactly designed. As a result, the water supply using the water level difference is difficult to realize unless the sizes of conventional dryer parts are changed. If a relatively small sized pump 400 is used, then there may be enough space for the steam generator 200 to be used without changing the sizes of the parts. It is very advantageous to use the pump 400 in accordance with this disclosure. If the steam generator 200 is not used for a relatively long time, the heater might be damaged by remaining water, stale water, or polluted water, which might be used later. Thus, it is preferable that the remaining water in the steam generator 200 is drained.

Water is supplied to the steam generator 200 through a lower portion of the steam generator 200 and steam is discharged from the steam generator 200 through the upper portion of the steam generator 200 in this embodiment. In this case, it is convenient to drain the remaining water in the steam generator 200.

In addition, it is preferable that a safety valve 500 is provided at a steam path through which steam is discharged from the steam generator 200 and the steam path is a steam hose 230.

Figure 5:
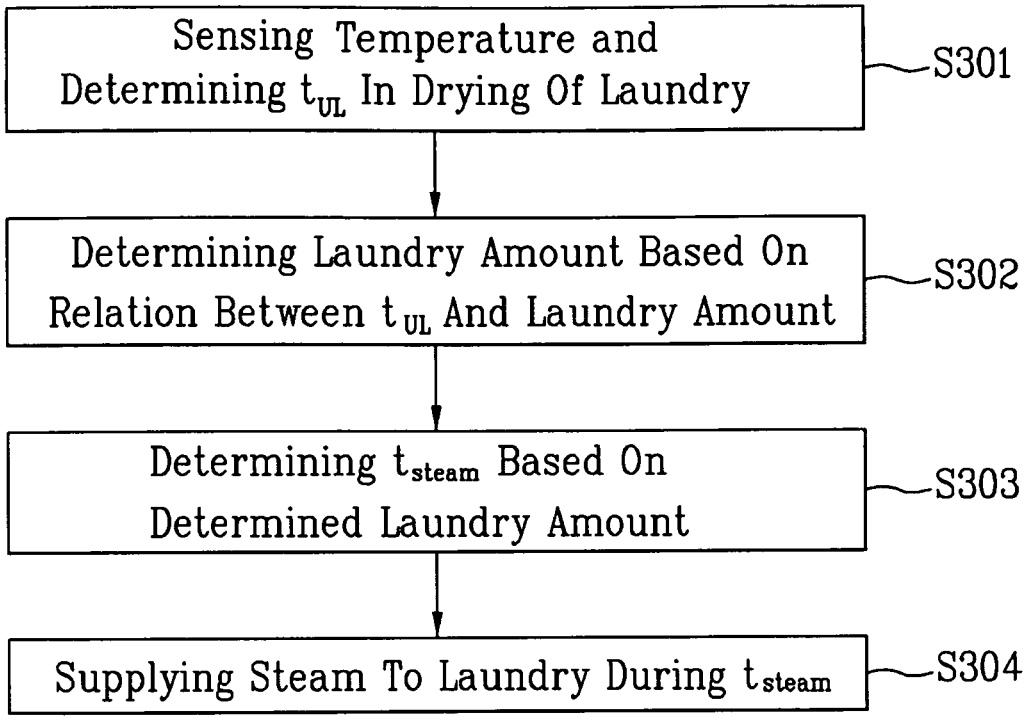
FIG. 5 is a flow chart of a method for detecting an amount of laundry according to the present invention.
Figure 6:
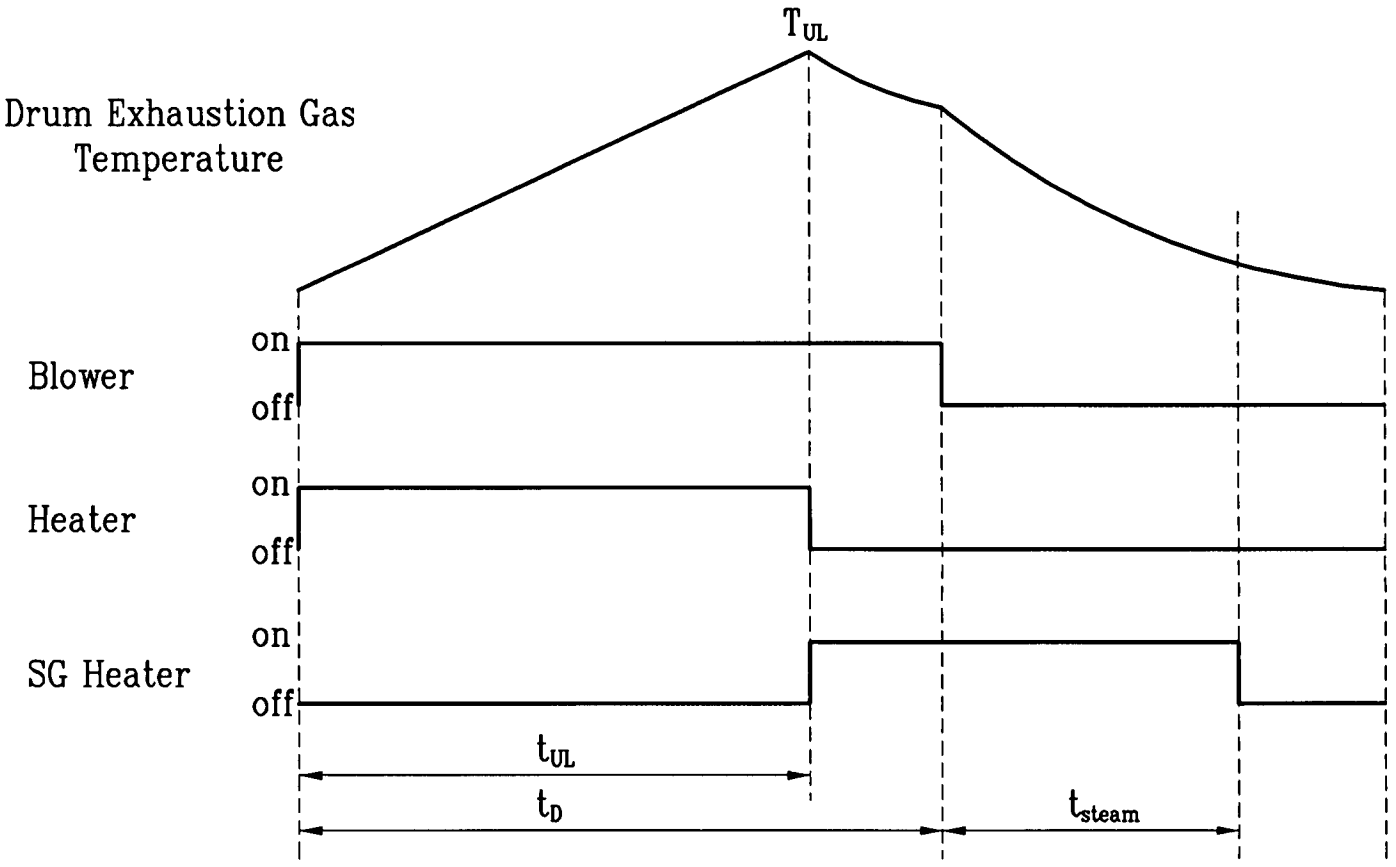
FIG. 6 is a diagram illustrating an operational state of configurations of the clothes dryer based on a time sequence.

Next, in reference to FIGS. 5 and 6, a controlling method based on a determined amount of laundry will be explained.

Laundry is dried by supplying hot air to the drum 20. During the drying process, the temperature of gas discharged from the drum 20 is sensed by a sensor installed in a front portion of the drum 20 to measure a time ($t_{UL}$) taken for the temperature to reach a limit temperature ($T_{UL}$) (S301). Here, a temperature inside the drum may be used instead of the temperature of the gas exhausted from the drum 20. Accordingly, a drum temperature sensor may be provided to sense temperature inside the drum 20. The limit temperature ($T_{UL}$) is a predetermined temperature at which the process of supplying of hot air is interrupted if the temperature of the gas is reached.

The time period ($t_{UL}$) corresponds to an amount of time that it takes for the temperature of gas exhausted from the drum 20 to reach the limit temperature from the start of the hot air heater 90 during the drying process.

Here, the relationship between the time ($t_{UL}$) taken to reach the limit temperature ($T_{UL}$) and the laundry amount is stored in a memory as a table and/or the relationship is inputted and/or stored as a formula. According to experiments, the laundry amount may be represented by a formula defined by a quadratic function of the time ($t_{UL}$).

The laundry amount is determined by using the table or the formula based on the time ($t_{UL}$) (S302).

Next, a steam supplying time ($t_{steam}$) corresponding to the determined laundry amount is determined in the above method (S303).

After the hot air heater 90 is turned off and the blower 62 is operated for a predetermined time period, the drying of the laundry is complete and designated by the drying time $t_D$. The heater 240 of the steam generator 200 is operated to heat the water inside the steam generator 200 prior to the completion of the drying of the laundry. As illustrated in FIG. 6, the heater 240 is turned on prior to $t_D$. As a result, steam is generated and supplied to the drum 20 at the moment when the drying process is complete.

In this embodiment, the heater 240 of the steam generator 200 starts to operate from when the temperature of gas exhausted from the drum 20 reaches the limit temperature ($T_{UL}$). Then, the drying of the laundry is complete at the moment when the water is heated and steam is generated.

After the drying of the laundry, the dryer begins to supply steam within the drum. At this time, the steam is supplied for a time period of a steam supplying time ($t_{steam}$) (S304) that is determined as mentioned above (S303).

Here, the relation between the laundry amount and the steam supplying time may be defined a linear model. That is, the steam may be supplied to the drum during the steam supplying time, which may be lengthened linearly based on an increased laundry amount.

The relation between the laundry amount and the steam supplying time ($t_{steam}$) may be varied according to purpose of applying steam to the dryer. For example, the relation of using steam to remove wrinkles may be different from the relation of using steam to remove static electricity. Also, the relation (for example, the linear relation) may be identical but the steam supplying time ($t_{steam}$) may be varied based upon the purpose of using the steam cycle.

The relation between the laundry amount and the steam supplying time ($t_{steam}$) may be achieved by experiments (and/or various iterations) to determine an optimal steam supplying time according to a laundry amount.

It will be apparent to those skilled in the art that various modifications and variations can be made without departing from the spirit or scope of the invention. Thus, it is intended that the claims appended hereto cover the modifications and variations.

What is claimed is:

1. A controlling method of a dryer, the controlling method comprising:

performing a drying process by supplying hot air to a drum to remove water from laundry;

measuring a drying time period, wherein the drying time period is determined to be an amount of time taken to perform the drying process completely;

determining an amount of laundry based on the drying time period; and supplying fine droplets of water to the drum according to the determined amount of laundry after the drying process is completed to release or remove wrinkles from the laundry, wherein said supplying of fine droplets of water comprises determining a moisture supply time period according to the determined amount of laundry and supplying fine droplets of water during the moisture supply time period.

2. The controlling method of claim 1, wherein the drying time period is determined to correspond to an amount of time for a sensed temperature to rise from a first temperature to a second temperature.

3. The controlling method of claim 2, wherein the second temperature is a predetermined limit temperature at which the supplying of the hot air is interrupted.

4. The controlling method of claim 2, wherein the sensed temperature is based on a sensed measurement of air flowing out of the drum.

5. The controlling method of claim 1, wherein the drying time period is determined to correspond to an operation time of a heater to heat the air.

6. The controlling method of claim 1, wherein the fine droplets of water comprises steam.

7. The controlling method of claim 6, wherein the steam is generated from a steam generator.

8. The controlling method of claim 7, wherein water in the steam generator is heated before the drying process is completed.

9. A controlling method of a dryer, the controlling method comprising:

performing a drying process by supplying hot air to a drum to remove water from laundry;

measuring a drying time period, wherein the drying time period is determined to be an amount of time taken to perform the drying process completely;

determining an amount of laundry based on the drying time period; and supplying steam to the drum according to the determined amount of laundry after the drying process to release or remove wrinkles from the laundry, wherein water in a steam generator is heated before the drying process is completed, and wherein said supplying of steam comprises determining a moisture supply time period according to the determined amount of laundry and supplying steam during the moisture supply time period.

10. The controlling method of claim 9, wherein the drying time period is determined to correspond to an amount of time for a sensed temperature to rise from a first temperature to a second temperature.

11. The controlling method of claim 10, wherein the second temperature is a predetermined limit temperature at which the supplying of the hot air is interrupted.

12. The controlling method of claim 10, wherein the sensed temperature is based on a sensed measurement of air flowing out of the drum.

13. The controlling method of claim 9, wherein the drying time period is determined to correspond to an operation time of a heater to heat the air.

14. A controlling method of a dryer, the controlling method comprising:

performing a drying process by supplying hot air to a drum to remove water from laundry;

measuring a drying time period, wherein the drying time period is determined to be an amount of time taken to perform the drying process completely or an operation time of a heater to heat the air during the drying process;

determining an amount of laundry based on the drying time period; and supplying fine droplets of water to the drum according to the determined amount of laundry after the drying process is completed to release or remove wrinkles from the laundry, wherein said supplying of fine droplets of water comprises determining a moisture supply time period according to the determined amount of laundry and supplying fine droplets of water during the moisture supply time period.

15. The controlling method of claim 14, wherein the fine droplets of water comprises steam.

* * * * *